US006305409B1

(12) United States Patent
Furness

(10) Patent No.: US 6,305,409 B1
(45) Date of Patent: Oct. 23, 2001

(54) CONESTOGA COMBAT HOSE REEL AND RAPID INLAND PETROLEUM AND WATER DISTRIBUTION SYSTEM

(76) Inventor: Robert L. Furness, 2701 NE. 8th St., Pompano Beach, FL (US) 33062

( * ) Notice: Subject to any disclaimer, the term of this patent is extended or adjusted under 35 U.S.C. 154(b) by 0 days.

(21) Appl. No.: 09/631,434

(22) Filed: Aug. 2, 2000

Related U.S. Application Data

(63) Continuation of application No. 09/290,567, filed on Apr. 13, 1999, now Pat. No. 6,105,604.

(51) Int. Cl.[7] ..... A62C 35/00

(52) U.S. Cl. ..... 137/355.16; 137/899; 242/392; 242/403; 242/403.1; 54/3

(58) Field of Search ..... 137/355.16, 899; 242/392, 403, 403.1; 54/3

(56) References Cited

U.S. PATENT DOCUMENTS

| | | | | |
|---|---|---|---|---|
| 70,502 | * | 11/1867 | Barnes | 54/3 |
| 613,951 | * | 11/1898 | Woods | 242/403 |
| 902,801 | * | 11/1908 | Bergland | 242/403.1 |
| 1,165,277 | * | 12/1915 | Munson | 242/403.1 |
| 1,250,011 | * | 12/1917 | Reber | 242/403 |
| 1,726,137 | * | 8/1929 | Bernal | 242/403 |
| 2,293,796 | * | 8/1942 | Bestor | 137/899 |
| 2,610,003 | * | 9/1952 | Bond et al. | 242/403.1 |
| 2,760,818 | * | 8/1956 | Cartwright | 137/899 |
| 3,152,772 | * | 10/1964 | Schjerven | 242/403.1 |
| 3,587,626 | * | 6/1971 | Cowley | 137/355.12 |
| 3,652,026 | * | 3/1972 | Awebro | 242/557 |
| 3,976,260 | * | 8/1976 | Irik | 242/403 |
| 4,784,221 | * | 11/1988 | Share et al. | 166/52 |
| 5,626,307 | * | 5/1997 | Smith | 242/403.1 |
| 5,775,621 | * | 7/1998 | Sauber | 242/391.1 |

* cited by examiner

*Primary Examiner*—A. Michael Chambers
(74) *Attorney, Agent, or Firm*—Malin, Haley & DiMaggio, P.A.

(57) ABSTRACT

A portable deployment and retrieval hose reel for deploying and retrieving a continuous hose is disclosed. The hose reel includes an independently rotatable drum member disposed between two flange members, which are preferably in the form of wheels. The wheels are similar to conestoga type wagon wheels. The wheels and drum member define a conduit storage area. Preferably, the spokes of the wheels are canted at least slightly outward from their attachment at one end to a central wheel hub and at their opposite end to the outer peripheral rim of the wheel. The use of the conestoga type wheels allows the hose reel to be transported over non-developed topography and rough surfaces, often unaccessible by land vehicles. The outer peripheral surface of the wheels can be provided with an anti-abrasive surface, such as a rubber coating or urethane. The attachment of the wheels by an axle extending through the drum, allows the drum part of the hose reel to rotate freely or independently of the rotation or turning of the wheels. A yoke assembly is provided for moving and transporting the hose reel. To attach the yoke assembly to the wheels of the hose reel, a pair of shackle plate assemblies are provided. A is stacked around the drum preferably in a flat position.

25 Claims, 14 Drawing Sheets

FIG. 17 — Conduit Special Fittings

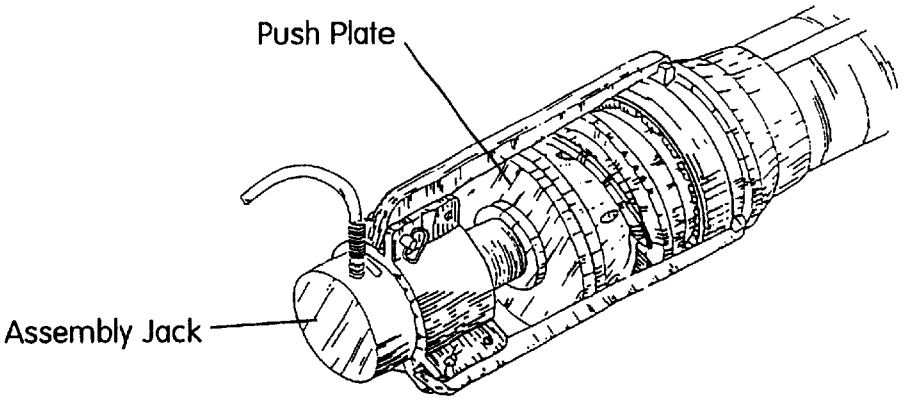
FIG. 30
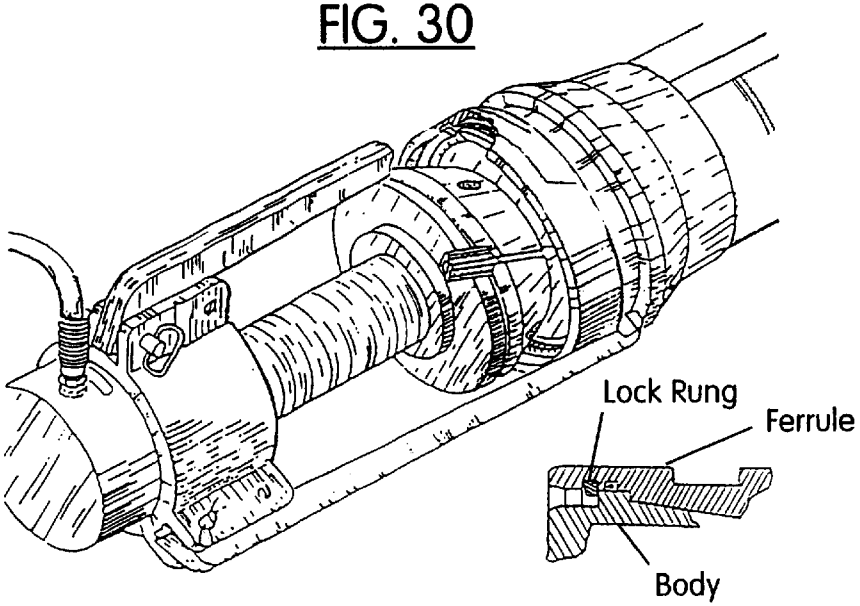
FIG. 31 — Outtake of Repair Coupling Procedure

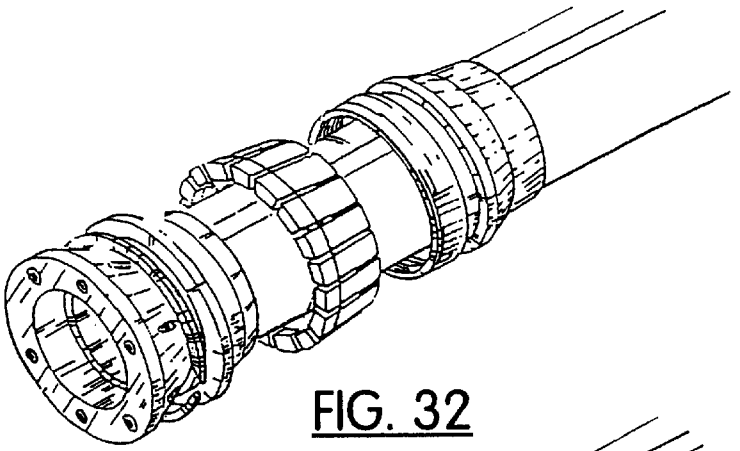
FIG. 32
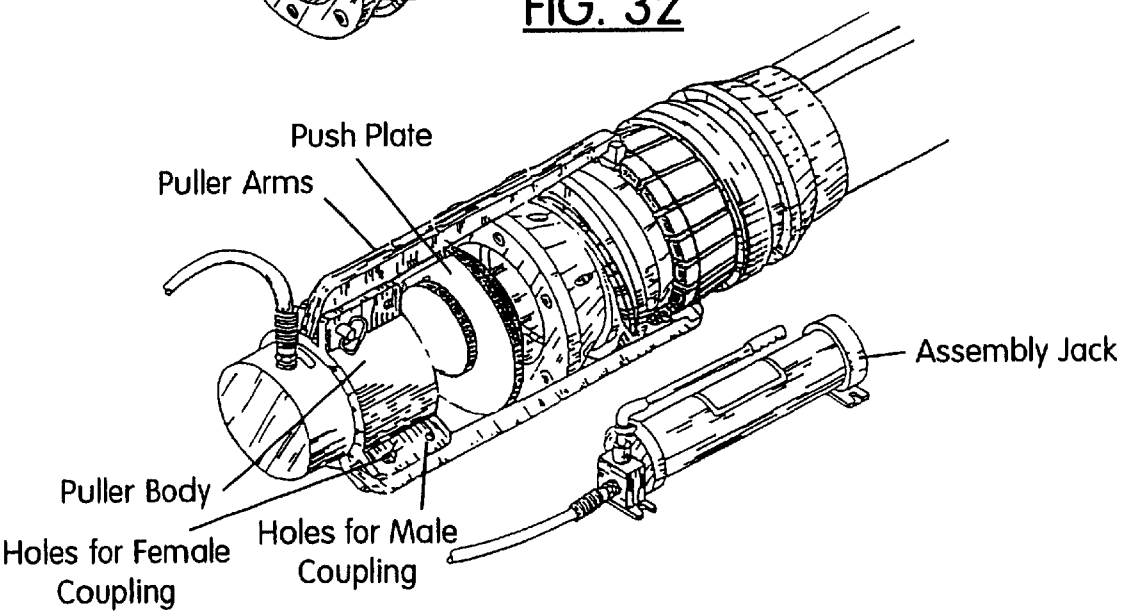
FIG. 33 — Outtake of Repair Coupling Procedure

CONESTOGA COMBAT HOSE REEL AND RAPID INLAND PETROLEUM AND WATER DISTRIBUTION SYSTEM

This application is a Continuation Application of U.S. patent application Ser. No. 09/290,567, which was filed on Apr. 13, 1999, now U.S. Pat. No. 6,105,604.

BACKGROUND OF THE INVENTION

1. Field of the Invention

The present invention relates generally to liquid distribution systems and particularly, to a transportable conestoga combat hose reel and rapid inland petroleum and water distribution system.

2. Description of the Prior Art

Temporary and permanent liquid distribution systems are often needed by the military during wartime conditions, as well as for training exercises. Most often these distribution systems are required for the conveyance of fuel and/or water. Over the past decade, throughput demands on the strategic fuel transfer of the military have continuously increased.

In creating temporary and permanent military fluid distribution systems, a pipeline is used, typically formed by laying and connecting nineteen (19') foot aluminum pipe sections along a designated area. This type of pipeline construction is time consuming and labor intensive, often requiring hundreds of soldiers in order to complete the pipeline in a somewhat reasonable period of time. As mentioned above, the pipeline is formed from nineteen foot sections, thus, requiring the labor and time of connecting the pipe every nineteen feet. Furthermore, each connection point increases the opportunity for a leak to occur, which may be dangerous especially where petroleum and/or other liquid chemicals are being transported through the pipeline. Current pipelines are typically built during the day, given the problems of lighting at night especially when laying a pipeline on non-developed terrain locations. Thus, even with hundred of soldiers working to construct the pipeline, typically only about two (2) miles a day of pipeline can be constructed.

When laying a pipeline on a non-developed terrain, another problem is the ability of access. If the pipeline is to built in or by the jungle, due to the demands of a current war or training exercise, it may not be possible to drive trucks carrying the nineteen foot pipe section to a location reasonably near to where the pipeline is to be built. If the trucks can't access at least the neighboring area, then it often becomes impractical and dangerous to require soldiers to carry the pipe sections over large areas to reach the pipeline designation. Thus, in these situation, the pipeline, though being important, may not be built. Therefore, it is to the effective resolution of the aforementioned and shortcomings of the prior art that the present invention is directed.

SUMMARY OF THE INVENTION

The present invention provides a portable deployment and retrieval hose reel for deploying and retrieving a continuous hose, preferably for use as a fuel and water pipeline. The hose reel includes a rotatable drum member disposed between two flange members, which are preferably in the form of wheels. The wheels are similar to conestoga type wagon wheels. The wheels and drum member define a conduit storage area. Preferably, the spokes of the wheels are canted at least slightly outward from their attachment at one end to a central wheel hub and at their opposite end to the outer peripheral rim of the wheel.

The canting of the spokes outward provides extra clearance when unraveling the hose to create the pipeline, which will be discussed in further detail below. Thus, the canted spokes reduce the friction factor of the hose at the top of the reel and allows the drum to turn more easily as the edges of the hose at the top are less likely to drag against the inside of the flange/wheel as the whole hose reel is trying to turn or rotate. The use of the conestoga type wheels allows the hose reel to be transported over non-developed topography and rough surfaces, often unaccessible by land vehicles. The outer peripheral surface of the wheels can be provided with an anti-abrasive surface, such as a rubber coating or urethane.

The two wheels are connected to each through an axle member, which is attached to the hub portions of the wheels by conventional means such as welding. The drum is preferably hollow to define a passageway extending through the drum. The relationship of the drum to the two wheels is maintained be passing the axle through the drum. Thus, a substantial portion of the axle is disposed within the drum's passageway, with the end portions of the axle attached to the hub portions of the wheels. Preferably, the axle itself is also hollow to define an axle passageway extending through the axle.

The attachment of the wheels by an axle extending through the drum, allows the drum part of the hose reel to rotate freely or independently of the rotation or turning of the wheels. This feature reduces the tensions of unraveling the hose, especially during the end of the unraveling, as it allows extra hose to be pulled off the reel.

A towing and lifting handle, preferably in the form of a yoke assembly is provided for moving and transporting the hose reel. Yoke assembly includes a substantially "U"-shaped member, consisting of first and second arms and a cross bar (which all can be constructed integral), and an towing vehicle attachment assembly consisting of a chain member and a towing vehicle connector. The hose reel acts as the prime mover. The chain member is preferred, as it can easily folded or packed to allow the hose reel with yoke assembly attached to fit within an iso container or iso flat rack. However, where the hose reel is not stored in iso container or iso flat rack, rigid arm member can be provided in lieu of the chain member.

To attach the yoke assembly to the wheels of the hose reel, a pair of shackle plate assemblies are provided. Each shackle plate assembly consist of a bearing plate and a swivel plate. The bearing plates are attached to the outer surfaces of the hub portions of the wheels by conventional means such as bolts. The bearing plate is provided with a sloping outer surface having an outer diameter which is slightly smaller than an inner diameter of a similar shaped sloping surface of the swivel plate. To attach, the swivel plate is slipped over the bearing plate to allow the sloping surfaces to abut each other which also provides for a snug, yet rotatable, fit between the bearing plate and the swivel plate. The interface of the two corresponding conical surfaces maintains the relationship between the swivel plate and the bearing plate. Thus, when the hose reel rolls, the bearing plate rotates freely inside the swivel plate, which remains relatively constant and is attached to the yoke assembly.

The swivel plate is provided with at least one ear member, and preferably three ear members. Each arm of the U-shaped member of yoke assembly can be attached to one of the ear members of the swivel plate by conventional means, such as thrust pins. The other two ear members can be used for tie-downs of the hose reel or for lifting by a helicopter.

An opening is provided in the center area of the swivel plate and the bearing plate which are in communication with an opening in the center of the wheel hubs which can be in communication with the opening in the wheel axle. The openings allows the hose reel to receive a keeper bar to hold tensions on the hose reel when it's on a cradle. Furthermore, along the outer surface of the rim of the wheel, a plurality of reattachable lifting eyes or forklift guides or holes can also be provided.

A fluid conduit, such as a somewhat flexible hose, is wrapped or stacked around the drum preferably in a flat position. A vacuum is created to deflate the hose to its flat wrapping position, or the hose can be packed by tensile stress to achieve its flatness. By vacuum or tensile packing the hose, a maximum length of hose can be wrapped around the drum. Given the dimensions of the drum and wheel members discussed above, in the preferred embodiment the hose exceeds seven hundred (700') feet in length, and can be between nineteen (19') to one thousand (1000') feet in length. The hose is preferably either six (6") inches or eight (8") inches in diameter. However, the above lengths and dimensions for the hose are given by way of example and should not be considered limiting.

In the preferred embodiment, the hose is constructed from two (2) plies of wire, built along the lines of a radial tire. Other number of plies of wire, such as four (4) ply and six (6) ply, can also be utilized and are considered within the scope of the invention. The hose is constructed from high tensile, steel reinforcement with a tube where the fuel or water would travel through, preferably constructed from nitrile or EDPM (a food grade liner), and an abrasion resistant cover, preferably constructed from chloroprene. However, these materials are provided by way of example, and should be understood that other materials yielding similar functional characteristics can be provided for the construction of the hose and are considered within the scope of the invention. The elasticity of the hose (conduit) allows for variations in the topography to which it will rest upon.

Attached to each end of the hose are low profile fitting, preferably constructed from aluminum, though other conventional materials can be used and are considered within the scope of the invention. The fittings have either male or female characteristics for attachment to either other male or female fittings or other connectors of various equipment such as vacuums, pig launchers, pig receivers, drainage devices, etc,. The fittings can be preferably built into the ends of the hose by conventional means.

The structure of the present invention allows for shipping, deployment and retrieval all from the same prime mover (i.e. the portable hose reel itself). The present invention allows for the laying of a high strength three thousand (3000) psi collapsible or advanced collapsible pipeline, constructed from the continuous hose (conduit), which can be laid off of a wheel in unimproved roads and allows for lengths of pipeline exceeding forty (40) miles a day during twenty (20) hour work days.

The portable hose reel can be functionally towed by any number of military or civilian vehicles. The hose reel can also be deployed by helicopter over gap and river crossings. In its simplest form, a load is applied to the hose reel which causes the hose to unravel.

Prior to unraveling the hose to create the pipeline, a pipeline trace, in the form of a string of chemical lights, can be provided. The chemical lights are preferably spaced approximately ten (10) to twelve (12) feet from each other, though such distance is not considered limiting. The chemical lights automatically break out using a ratchet mechanism when pulling the string from its own storage reel or flaking box. Typically, the string of chemical lights lies directly on the ground or are attached to stakes which are inserted in the ground.

In a typical scenario, a nighttime grouping of military soldiers would lay a pipeline trace in conjunction with infrared lighting by laying the chemical lights to define the location of the pipeline. Using the present invention hose reel or some other device, the pipeline would be created following the trail of the pipeline trace created by the chemical lights. Other lights, other than chemical lights, such as fluorescent may be used and are also considered within the scope of the invention.

The present invention is preferably dimensioned, with hose wrapped around the drum, to fit within a conventional iso container or an iso flat rack. Thus, when used with an iso container or iso flat rack, the hose reel can be approximately seven (7') feet wide by seven (7') feet tall. However, it should be understood that the present invention is not limited to any one set of dimensions.

Accordingly, it is an object of the present invention to provide a portable hose deployment and retrieval hose reel.

It is another object of the present invention to provide a portable hose deployment and retrieval hose reel having conestoga type wheels installed in reverses orientation.

It is a further object of the present invention to provide a portable hose deployment and retrieval hose reel which can be transported over many different types of developed and undeveloped terrains and topography.

It is still a further object of the present invention to provide a portable hose deployment and retrieval hose reel having a drum and wheels and which allows the drum to rotate independent of the wheels.

It is still another object of the present invention to provide a single device which can used for shipping, deployment and retrieval of a elongated continuous hose.

It is yet still another object of the present invention to provide a portable hose deployment and retrieval hose reel, with hose wrapped around the drum of the hose reel device, which fits within an iso container or iso flat rack.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which:

FIGS. 30 through 33 illustrates a repair fitting and certain procedure steps in place permanent repair fitting on the hose.

DESCRIPTION OF THE PREFERRED EMBODIMENTS

Figure 10:
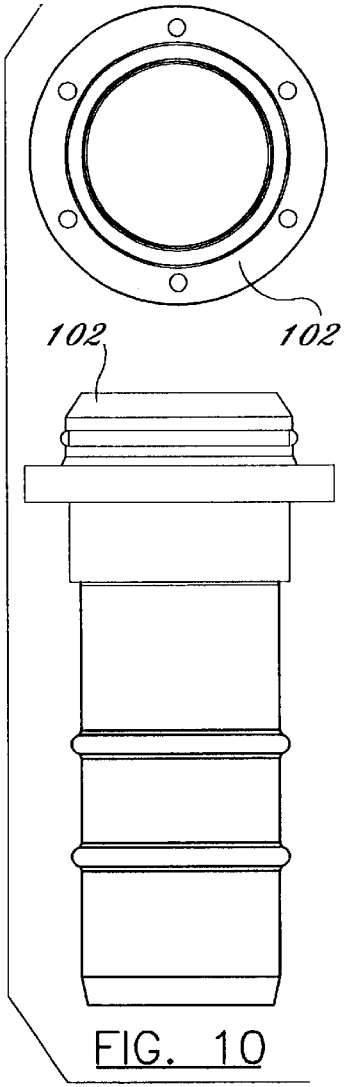
FIG. 10 illustrates a male low profile fitting which can be attached to one or more ends of the hose in accordance with the present invention.
Figure 9:
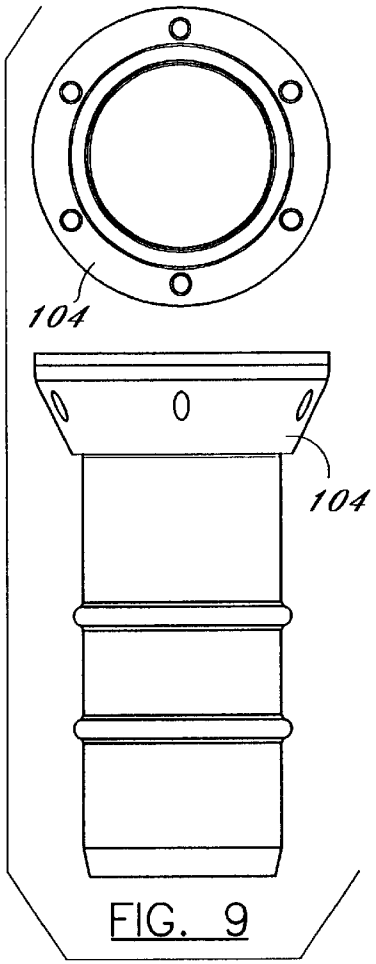
FIG. 9 illustrates a female low profile fitting which can be attached to one or more ends of the hose in accordance with the present invention.
Figure 1:
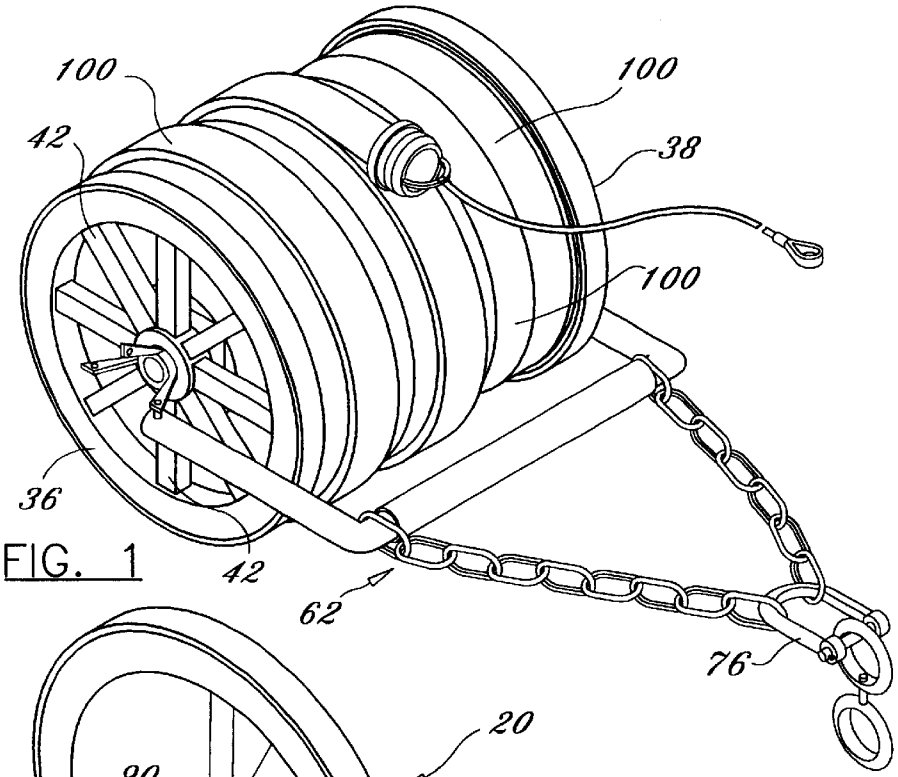
FIG. 1 illustrates a perspective view of the portable deployment and retrieval hose reel in accordance with the present invention.
Figure 2:
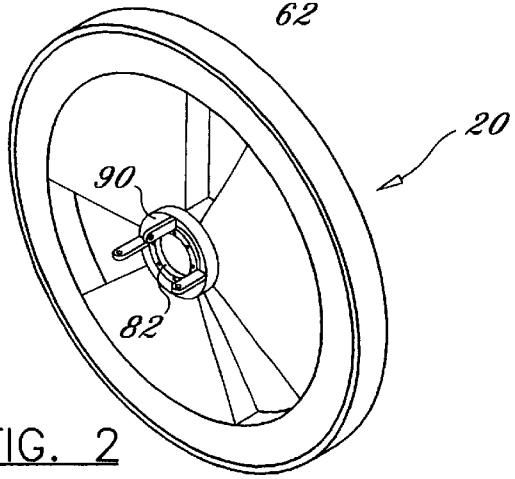
FIG. 2 illustrates an alternative flange member for the hose reel.
Figure 3:
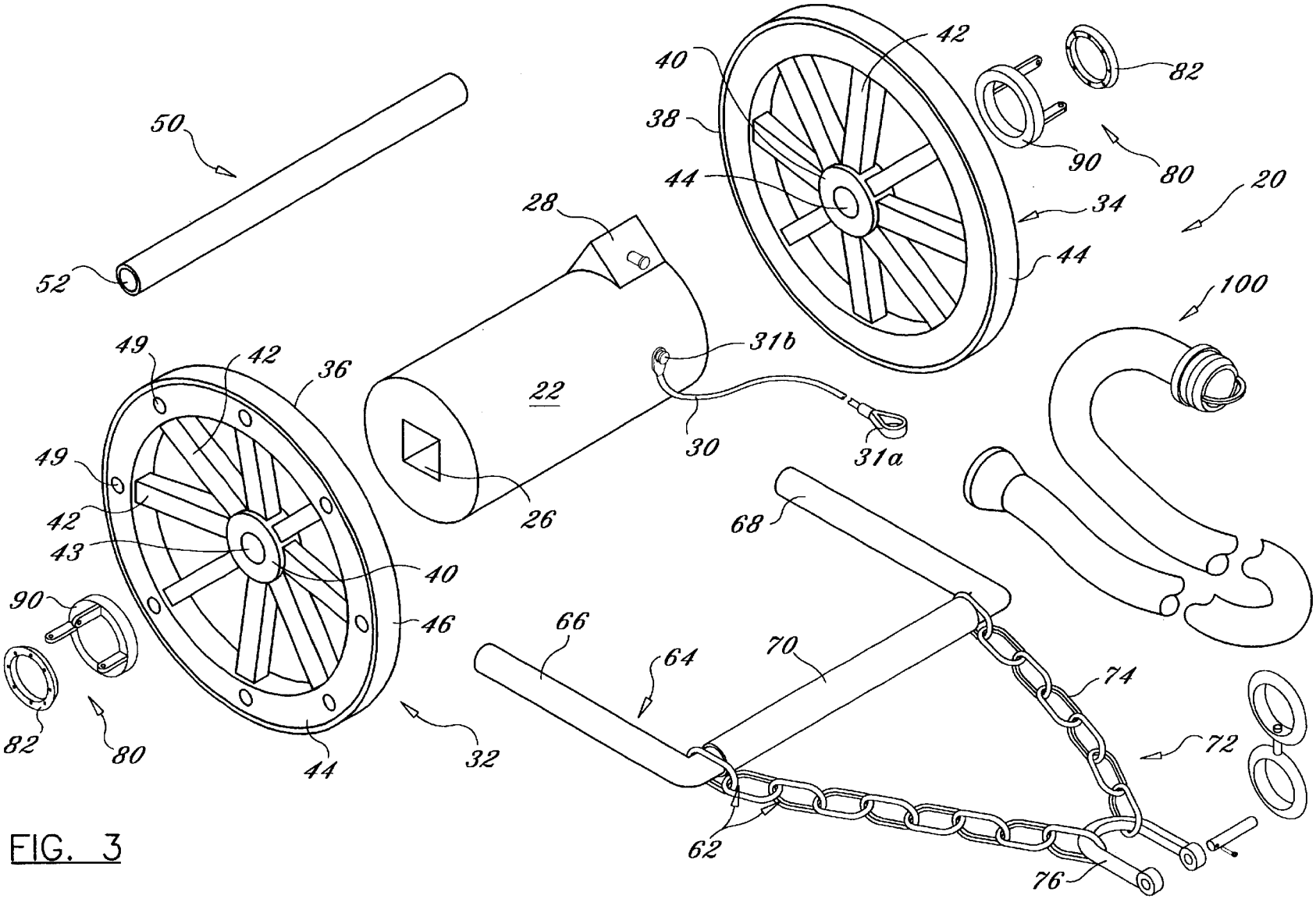
FIG. 3 illustrates an exploded view of the hose reel illustrated in FIG. 1.
Figure 7:
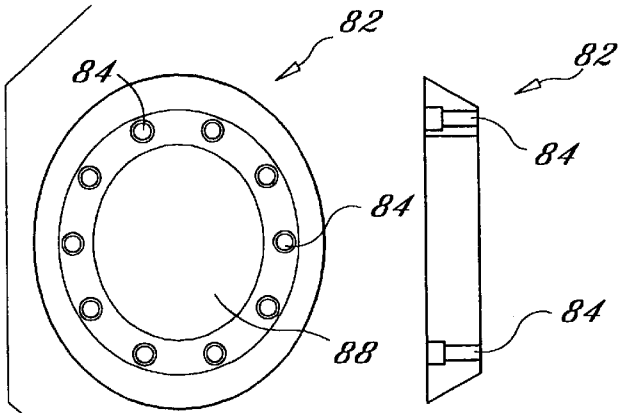
FIG. 7 illustrates the bearing plate of the shackle plate assembly in accordance with the present invention.
Figure 8:
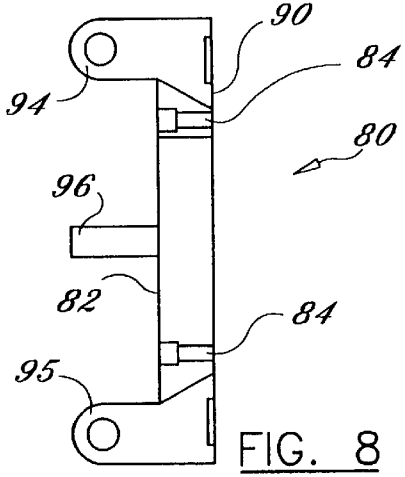
FIG. 8 illustrates a sectional view of the shackle plate assembly.

As seen in FIGS. 1 through 10, a portable deployment and retrieval hose reel in accordance with the present invention is illustrated and generally designated as hose reel 20. Hose reel 20 is used for deploying and retrieving a continuous hose 100, preferably for use as a fuel and water pipeline. Hose reel 20 includes a rotatable drum member 22 disposed between two flange members 32 and 34, which are in the preferred embodiment in the form of wheels 36 and 38. In an alternative embodiment, the flange members can take the shape of disc 37 (FIG. 2). Wheels 36 and 38 are similar to conestoga type wagon wheels. Wheels 36 and 38 and drum member 22 define a conduit storage area 24. Each wheel 36 and 38 includes a hub portion 40, a plurality of spokes 42 and an outer rim portion 44. Preferably, spokes 42 are canted at least slightly outward from their attachment at one end to the central wheel hub 40 and at their opposite end to the outer peripheral rim 44 of wheels 36 and 38.

The canting of spokes 42 outward provides extra clearance where unraveling hose 100 to create the pipeline, which will be discussed in further detail below Thus, the canted spokes 42 reduce the friction factor of hose 100 at the top of hose reel 20 and allows drum 22 to turn more easily as the edges of hose 100 at the top are less; likely to drag against the inside of the flange/wheels 36 and 38, as the whole hose reel 20 is trying to turn or rotate. The canting of spokes 42 also allows the shackle plate assembly to be recessed, thus, providing more clearance for the shackle plate assembly) in an iso container, as well as providing more clearance for a cradle drive.

The use of the conestoga type wheels 36 and 38 allows hose reel 20 to be transported over non-developed topography and rough surfaces, often unaccessible by land vehicles. An outer peripheral surface 46 of outer rim 44 can be provided with an anti-abrasive surface 46, such as a rubber coating or urethane.

Wheels 36 and 38 are connected to each through an axle member 50, which is attached to hub portions 40 of wheels 36 and 38 by conventional means such as welding. Drum 22 is preferably hollow to define a passageway 26 extending through drum 22. The relationship of drum 22 to wheels 36 and 38 is maintained be passing axle 50 through drum 22. Thus, a substantial portion of axle 50 is disposed within the drum's passageway 26, with the end portions of axle 50 attached to hub portions 40 of wheels 36 and 38. Preferably, axle 50 itself is also hollow to define an axle passageway 52 extending through axle 50.

The attachment of wheels 36 and 38 by axle 50 extending through drum 22, allows drum 22 of hose reel 20 to rotate freely or independently of the rotation or turning of wheels 36 and 38. This feature reduces the tensions of unraveling hose 100, especially towards the end of the unraveling, as it allows extra hose to be pulled off hose reel 20.

Figure 11:
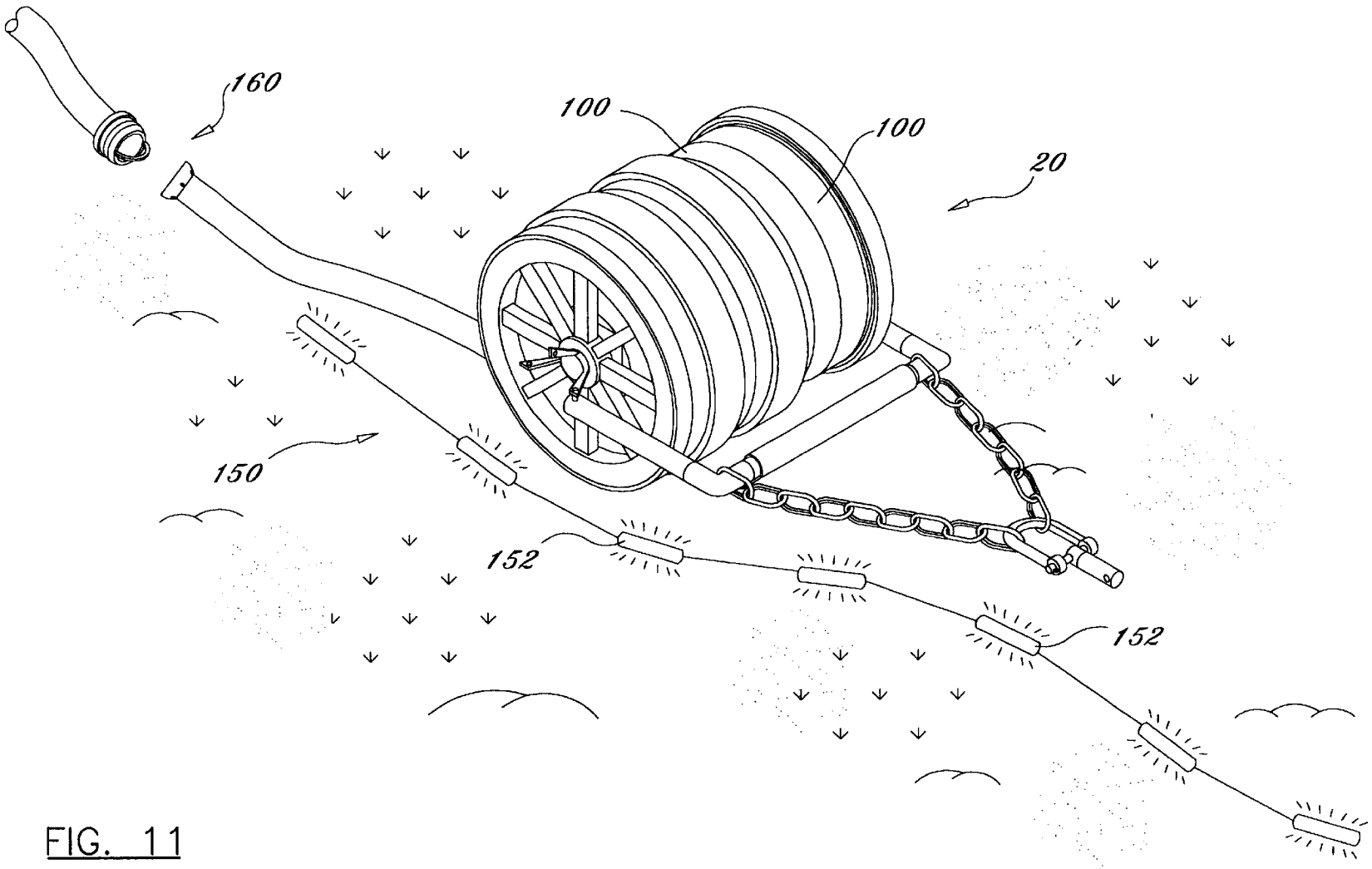
FIG. 11 illustrates a pipeline trace used prior to creating the pipeline in accordance with the present invention.

A towing and lifting handle, preferably in the form of a yoke assembly 62 is provided for moving and transporting hose reel 20. Yoke assembly 62 includes a substantially "U"-shaped member 64, consisting of first and second arms 66 and 68 and a cross bar 70 (which all can be constructed integral), and a towing vehicle attachment assembly 72 consisting of a chain member 74 and a towing vehicle safety shackle 76. Alternatively, arms 66 and 68 and cross bar 70 can be separate pieces attached to each other the use of elbows 71 (FIG. 11). Hose reel 20 itself is the prime mover for invention. Chain member 74 is preferred, as it can easily folded or packed to allow 20 hose reel, with yoke assembly 62 attached, to fit within a conventional iso container or iso flat rack (not shown). However, where hose reel 20 is not stored in iso container or iso flat rack, a rigid arm member can be provided in lieu of chain member 74. Cross bar 70 can be provided with one or more stop means, such as raised surfaces or collars 73, to prevent chain 74 from sliding along cross bar 70.

A swivel member is preferably attached to safety shackle 76. In one embodiment, the swivel member can be a no-bearing swivel 75 (FIG. 1). In an alternative embodiment, the swivel member can be a bearing swivel 77 (FIG. 11).

To attach the yoke assembly 62 to wheels 36 and 38 of hose reel 20, a pair of shackle plate assemblies 80 are provided. Each shackle plate assembly 80 consist of a bearing plate 82 and a swivel plate 90. Bearing plates 82 are attached to the outer surfaces 41 of hub portions 40 of the wheels by conventional means such as bolts, which are inserted through apertures 84 extending through the body of bearing plates 82. Bearing plate 82 is provided with a sloping outer surface 86 having an outer diameter which is slightly smaller than an inner diameter of a similar shaped sloping surface 92 of swivel plate 90.

To attach, swivel plate 90 is slipped over bearing plate 82 to allow sloping surfaces 86 and 92 to abut each other (FIG. 8) which also provides for a snug, yet rotatable, fit between bearing plate 82 and swivel plate 90. The interface of the two corresponding conical surfaces 86 and 92 maintains the relationship between swivel plate 90 and bearing plate 82. Thus, when hose reel 20 rolls, bearing plate 82 rotates freely inside swivel plate 90, which remains relatively constant and is attached to yoke assembly 62.

Swivel plate 90 is provided with at least one ear member 94, and preferably three ear members 94, 95 and 96. Arms 66 and 68 of U-shaped member 64 of yoke assembly 62 can be attached to one of the ear members 94, 95 or 96 of swivel plate 90 by conventional means, such as thrust pins (not shown)- The other two ear members 94, 95 and/or 96 can be used for tie-downs of hose reel 20 or for lifting of hose reel 20 by a helicopter.

Figure 18:
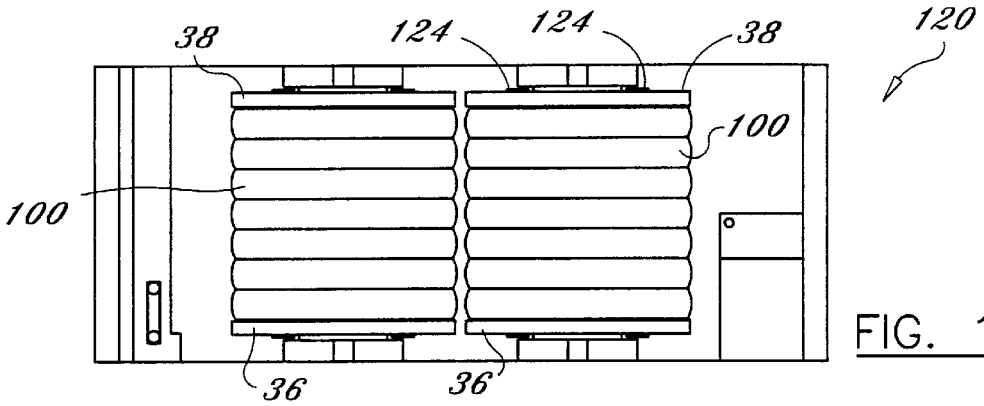
FIG. 18 illustrates a top view of the cradle containing one or more hose reels in accordance with the present invention.
Figure 19:
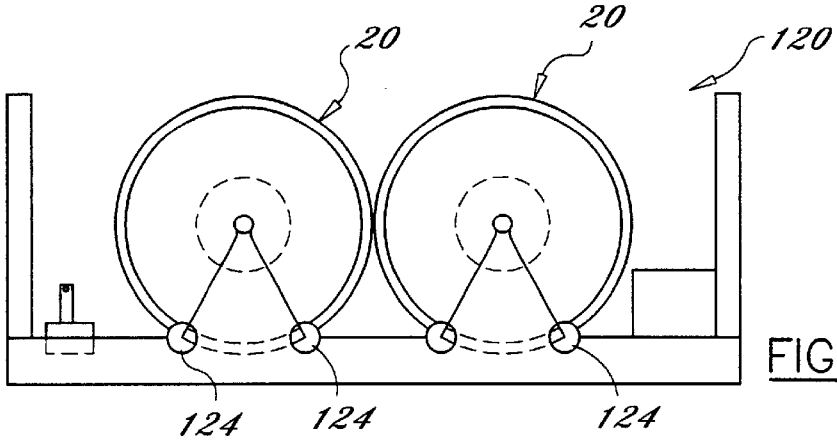
FIG. 19 illustrates a side elevational view of the cradle containing one or more hose reels in accordance with the present invention.

Openings 88 and 98, respectively, are provided in the center area of bearing plate 82 and swivel plate 90. Openings 88 and 98 are in communication with each other and an opening 43 in the center of the wheel hubs 40 which can be in communication with opening 52 of wheel axle 50. Openings 88, 98, 43 and sometimes, 52, allows hose reel 20 to receive a keeper bar (not shown) to hold tension on hose reel 20 when it's on a cradle (FIGS. 18 and 19). Furthermore, along an outer surface 48 of rim 44 of wheels 36 and 38, a plurality of reattachable crane lifting padeyes or forklift lifting guides or slots 49 can also be provided.

Hose reel 20 can also be converted to a "live" reel by incorporating a fluid path through the shackle plate assembly to the conduit fitting cam on drum 22. A nipple (not shown) is also preferably attached to the bearing plate for this conversion to a "live" reel.

Figure 4:
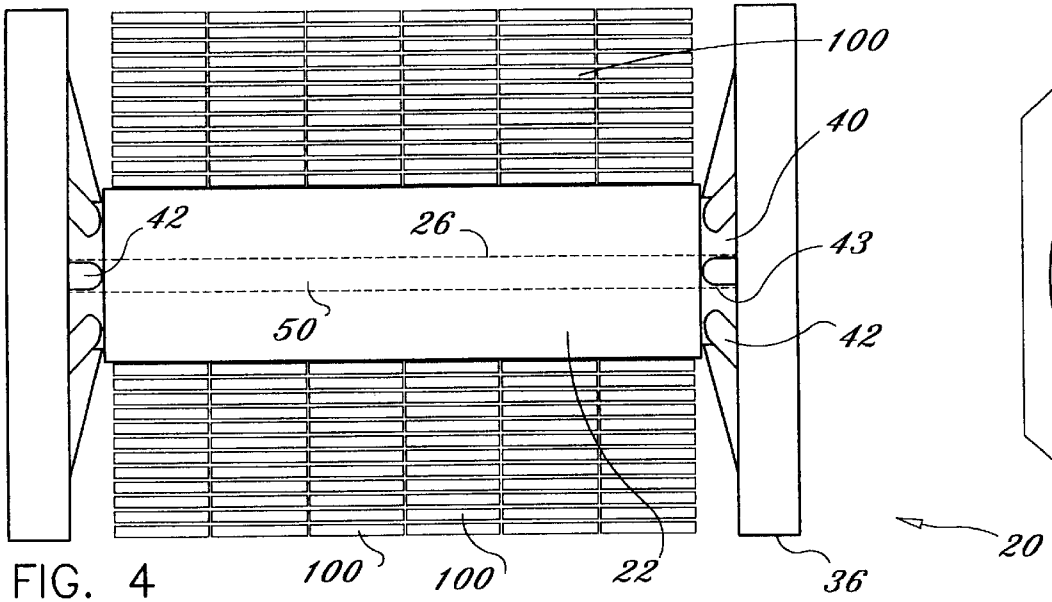
FIG. 4 illustrates a front elevational view of the hose reel illustrated in FIG. 1, with the hose shown in sectional.
Figure 6:
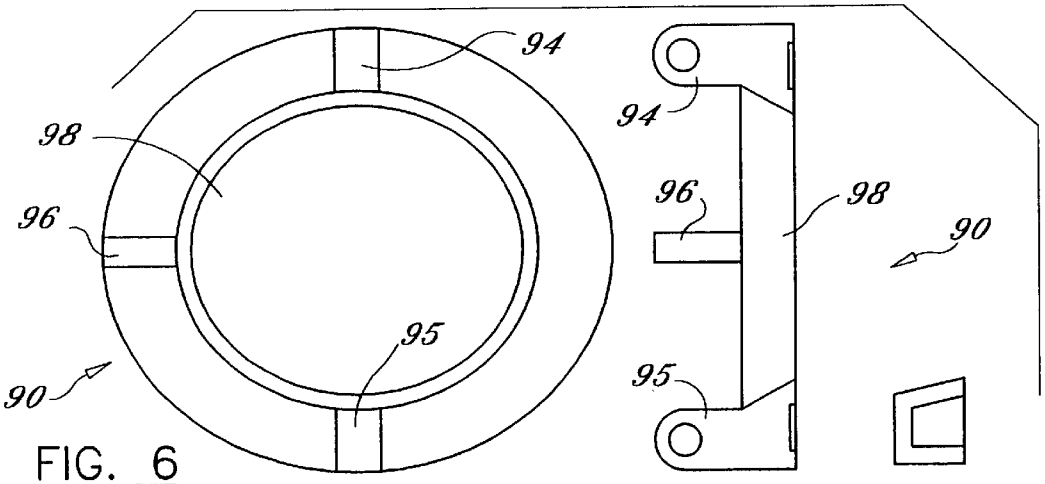
FIG. 6 illustrates the swivel plate of the shackle plate assembly ill accordance with the present invention.
Figure 5:
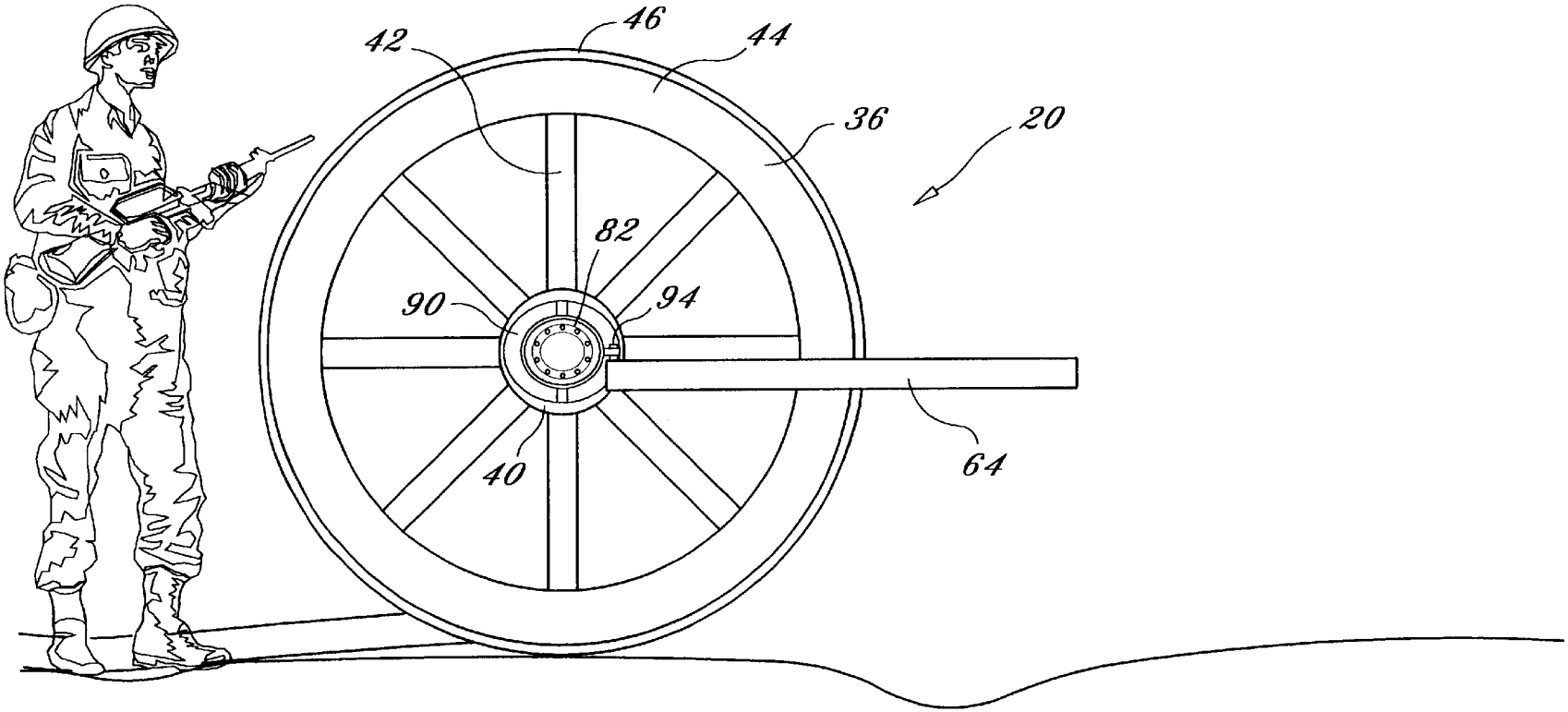
FIG. 5 illustrates a side elevational view of the hose reel illustrated in FIG. 1 and further illustrating a preferred size for the hose reel.

A fluid conduit, such as a somewhat flexible hose 100, is wrapped or stacked around drum 22 preferably in a flat position (FIG. 4). A vacuum is created to deflate hose 100 to its flat wrapping position, or hose 100 can be packed by tensile stress to achieve its flatness. By vacuum or tensile packing hose 100, a maximum length of hose 100 can be wrapped around drum 22. Given the dimensions of drum 22 and wheel members 36 and 38 discussed above, in the preferred embodiment hose 100 exceeds seven hundred (700') feet in length, and can be between nineteen (19') to one thousand (1000') feet in length. Hose 100 preferably has an inner diameter of either six (6") inches or eight (8") inches. However, the above dimensions for hose 100 are given by way of example and should not be considered limiting.

In the preferred embodiment, hose 100 is constructed from two (2) plies of wire, built along the lines of a radial tire. Other number of plies of wire, such as four (4) ply and six (6) ply, can also be utilized and are considered within the scope of the invention. Hose 100 is constructed from high tensile, steel reinforcement with a tube where the fuel or water would travel through, preferably constructed from nitrile, and an abrasion resistant cover, preferably constructed from chloroprene. However, these materials are provided by way of example, and should be understood that other materials yielding similar functional characteristics can be provided for the construction of the hose and are considered within the scope of the invention. The elasticity of hose 100 (conduit) allows for variations in the topography to which it will rest upon.

Preferably, when hose 100 is empty it is buoyant, and when it filled with fuel, it has more than a pound of negative buoyancy. Thus, hose 100 sinks when lied across a river or other body of water upon the introduction of fuel. As hose 100 is preferably flat when initially pulled off reel 20, once it is lying on the ground as the pipeline, hose 100 is exposed to eliminate the vacuum (i.e. by opening a vacuum fitting attached to one end of hose 100), thus allowing hose 100 to return to its natural substantially circular shape.

The six and eight inch inner diameter size hoses 100 preferably have the following physical characteristics, though such values should not be considered limiting:

| 6" I.D. | |
|---|---|
| Inside diameter (Nominal 6 inch) | MM = 152.4 |
| Outside diameter (Nominal 6.95 inches) | MM = 176.6 |
| Hose weight in air (7.78 lbs/ft) | Kg/m = 11.6 |
| Rated working pressure (750 psi) | Bar = 50 |
| Test pressure (1140 psi) | Bar = 75 |
| Burst pressure (2,250 psi) | Bar = 150 |
| Design bend radius (no min. bend radius) | MM = 800 |
| Axial load at break | S/Tons = 18 |
| Working axial Ioad | S/Tons = 2.25 |
| Pos. buoyancy in seawater empty | Kg/m = 13.5 |
| Neg. buoyancy in seawater filled (fluid SG.85) | Kg/m = 2.0 |
| Neg. buoyancy in seawater filled with water | Kg/m = 5.2 |
| Maximum temporary/assembly elongation | +1%–Nil |
| Aromatic resistance | Up to 50% |
| Fluid temperature range: | −29° C. to +92° C. |
| Flow velocity | Up to 21 m/s |
| **8" I.D.** | |
| Inside diameter (Nominal 8 inch) | MM = 203.3 |
| Outside diameter (Nominal 8.95 inches) | MM = 227.4 |
| Hose weight in air (10.53 lbs/ft) | Kg/m = 15.7 |
| Rated working pressure (580 psi) | Bar = 40 |
| Test pressure (870 psi) | Bar = 60 |
| Burst pressure (1,740 psi) | Bar = 120 |
| Design bend radius (no min. bend radius) | MM = 800 |
| Axial load at break | S/Tons = 25 |
| Working axial load | S/Tons = 3 |
| Pos. buoyancy in seawater empty | Kg/m = 25.9 |
| Neg. buoyancy in seawater filled (fluid Sg.85) | Kg/m = 1.67 |
| Neg. buoyancy in seawater filled with water | Kg/m = 7.3 |
| Maximum temporary/assembly elongation | +1%–Nil |
| Aromatic resistance | U to 50% |
| Fluid temperature range: | −29° C. to +92° C. |
| Flow velocity | Up to 21 m/s |

Hose 100 is strengthened by using high tensile filament wire cord which resists flexural fatigue and degradation.

Figure 14:
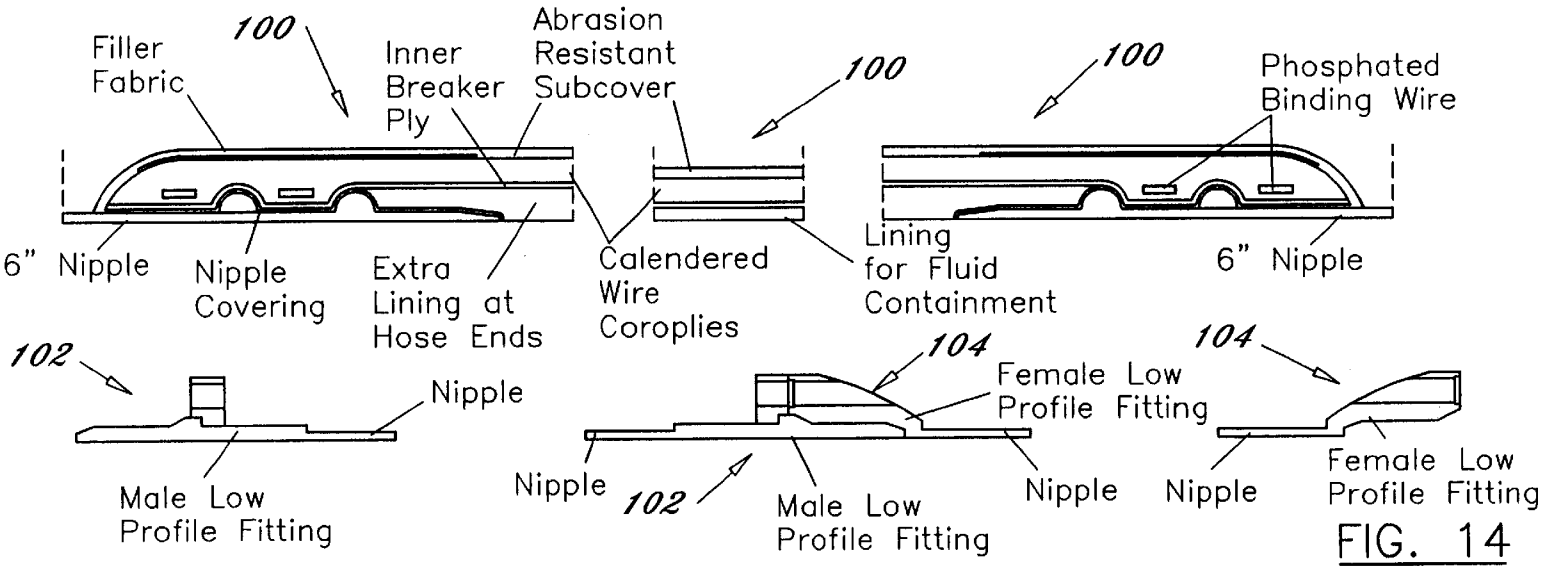
FIG. 14 illustrates a hose in accordance with the present invention having a six inch inner diameter.
Figure 15:
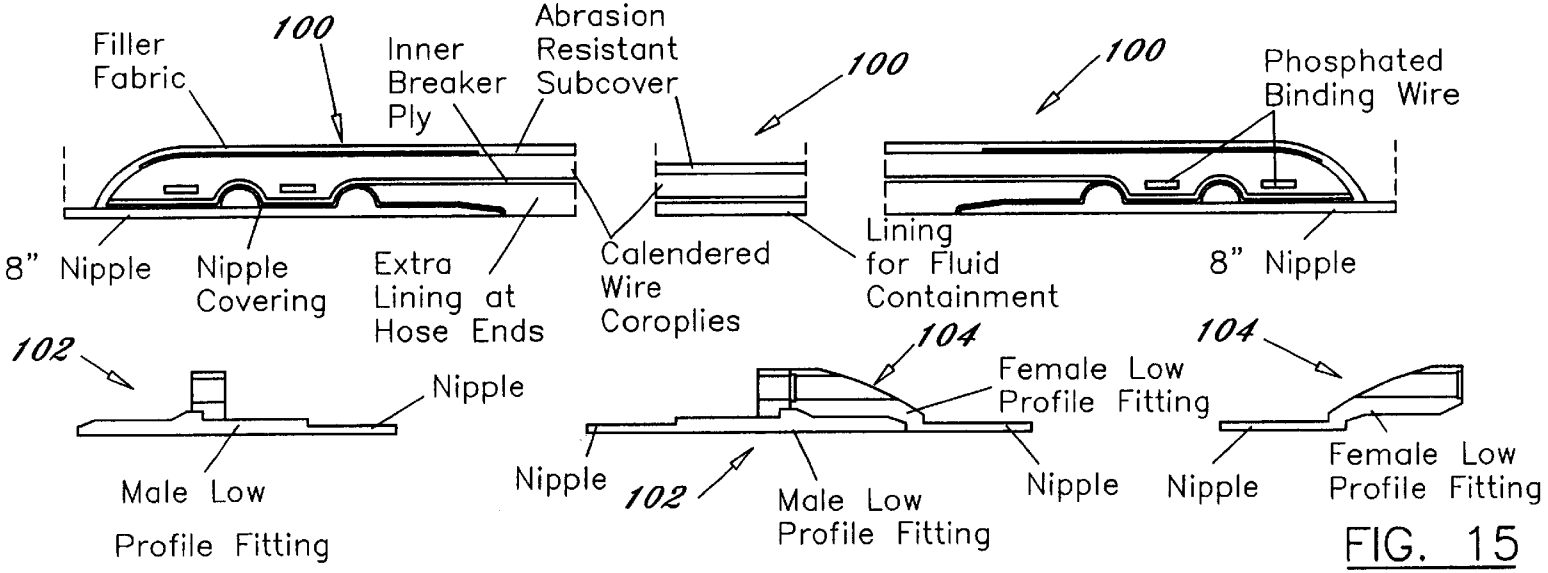
FIG. 15 illustrates a hose in accordance with the present invention having an eight inch inner diameter.
Figure 16:
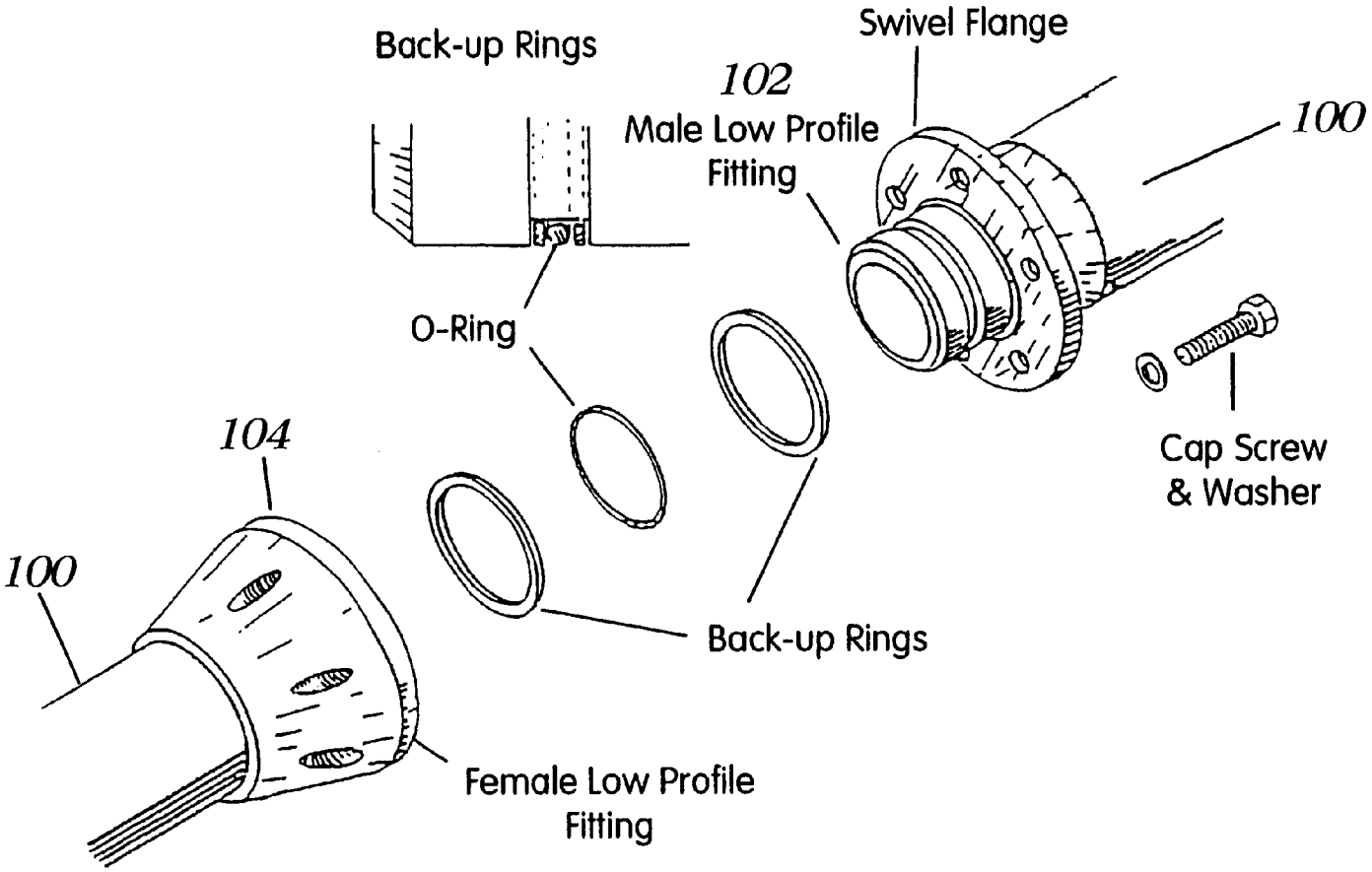
FIG. 16 illustrates an exploded perspective view of a connection of the male low profile fitting and the female low profile fitting.

Attached to each end of hose 100 are low profile fitting, preferably constructed from aluminum, though other conventional materials can be used and are considered within the scope of the invention. The fittings have either male 102 (FIGS. 14, 15 and 16) or female 104 (FIGS. 14, 15 and 16) characteristics for attachment to either other male or female fittings 102 or 104 or other connectors of various equipment such as vacuums, pig launchers, pig receivers, drainage devices, etc. The fittings can be preferably built into the ends of hose 100 by conventional means.

To properly maintain hose 100 on drum 22 when initially wrapping or retrieving around drum 22, a fitting cam 28, constructed integral with or attached to drum 22, and a relatively small wire rope 30 are provided. Wire rope is provided with loop ends 31*a* and 31*b*. One end 31*a* or 31*b* of rope 30 is attached to drum 22, preferably by connecting to an eyelet disposed at or approximate to fitting cam 28. The opposite end 31*a* or 31*b* of rope 30 is attached to either end of hose 100 itself or a fitting disposed at such end. When drum 22 begins to rotate rope 30 assures that the attached end of hose 100 is rest against fitting cam 28. Access to a fitting attached to the end of hose 100 is, provided through spokes 42 of wheel 36 or 38. Where discs 37 are provided in lieu of wheels 36 and/or 38, access to the fitting can be provided by provided one of more openings 39 in the disc.

Hose 100 is loaded on hose reel 20 preferably at the factory as hose 100 is. produced. Hose reel 20 and hose 100 are then preferably shipped together to the deployment theater. To deploy hose 100 over land (on-road and off-road), hose reel 20 is placed on the ground. Towing assembly 60 is attached to swivel plate 90 of shackle plate assembly 80 and to a towing vehicle (not shown) by connector 76. One end of hose 100 can be preferably secured to drum 100, by fitting cam 28 and rope 30. Hose reel 20 is then towed or otherwise moved forward, rolling and laying hose 100 as it progresses to form the pipeline.

Figure 22:
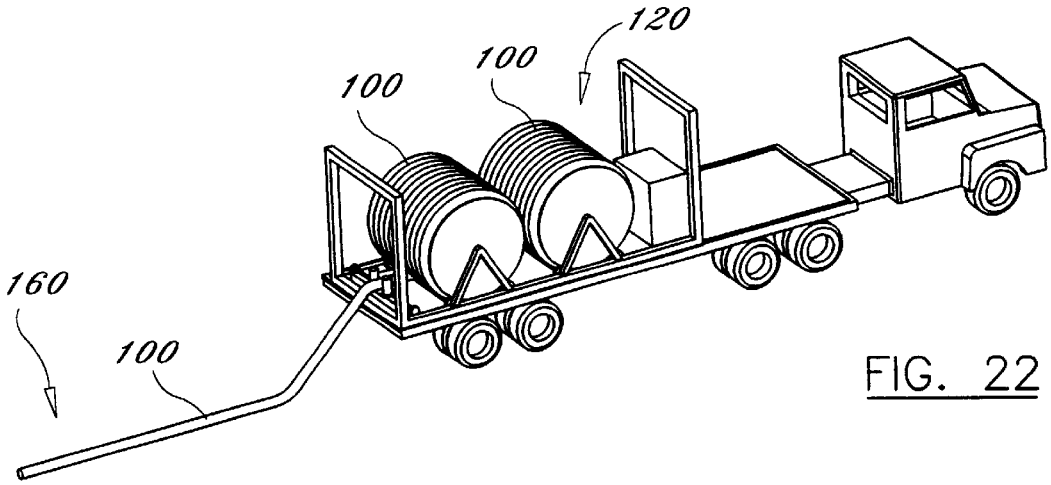
FIG. 22 illustrates a perspective view of a truck having a cradle and deploying the hose to create a pipeline in accordance with the present invention.
Figure 23:
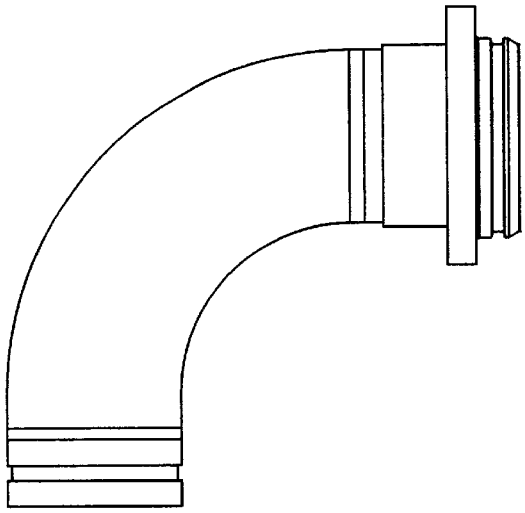
FIGS. 23 through 28 illustrate side elevational view of various pipe connectors (including elbows, "T"s, 45°s, etc.)
Figure 24:
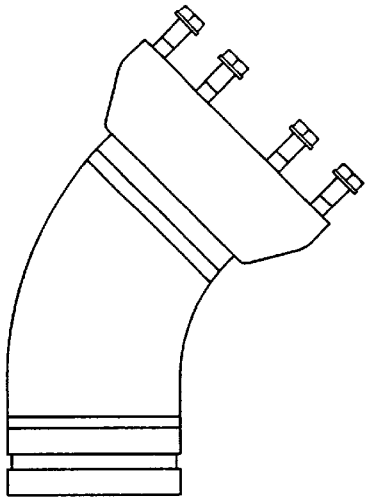
Figure 25:
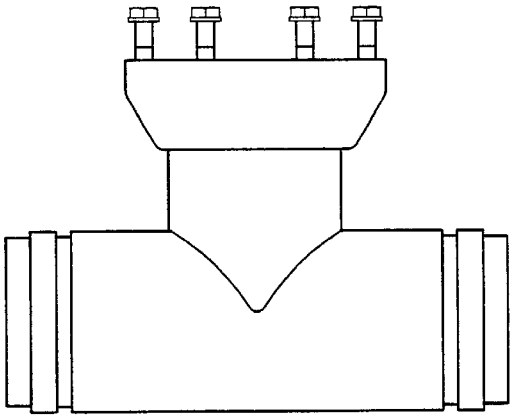
Figure 26:
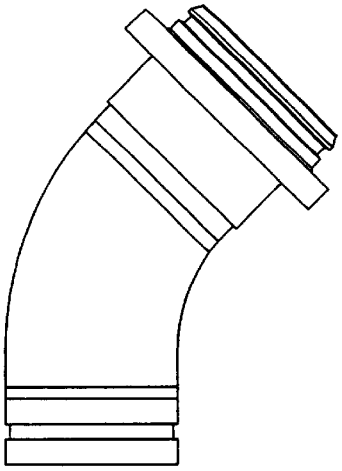
Figure 27:
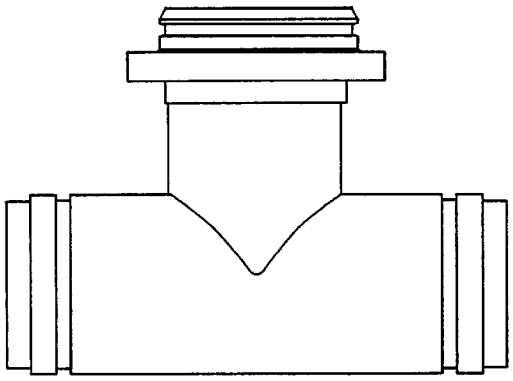
Figure 28:
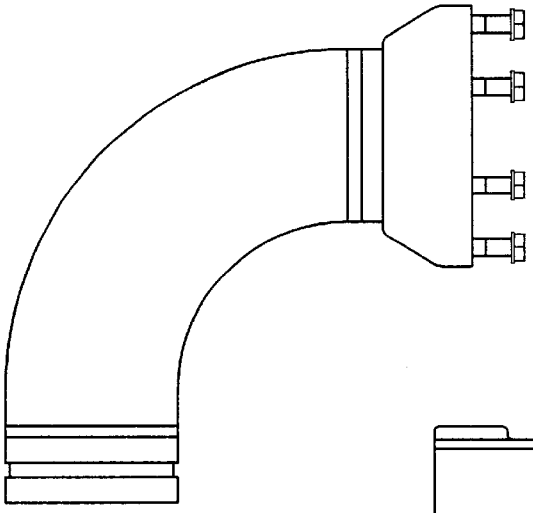
Figure 29:
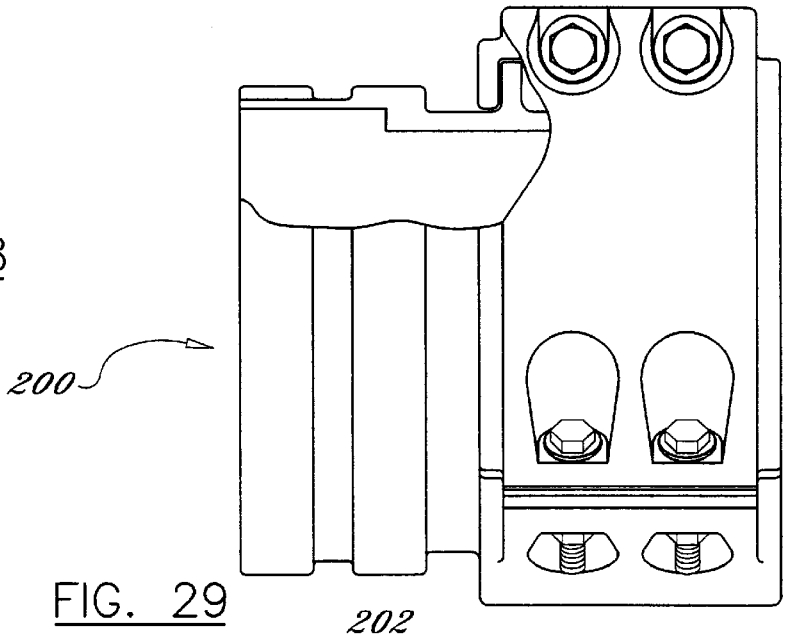
FIG. 29 is side sectional view of a repair fitting for use with the hose in accordance with the present invention.

An alternative deployment/retrieval method consist of using a support cradle 120 disposed upon a truck 130 (FIGS. 18, 19 and 22). Preferably, cradle 120 holds two hose reels 20 and has both free wheeling and friction drive capabilities. This deployment method would preferably be used when creating a pipeline on a relatively improved surface. Hose reel 20 is placed in cradle 120 by being disposed on four trunions 122 of cradle 120, to allow it to ride on the wheels 124 of the trunions when pulling hose 100 from hose reel 20. As cradle 120 is towed (preferably on a flat rack, trailer or other military vehicles), hose 100 is pulled off of hose reel 20, either by free wheeling or by powering hose 100 off hose reel 20 by a friction drive.

The lay rates of the present invention are approximately two (2) miles of hose 100 per hour when deploying, and four (4) miles per hour when retrieving. Either a friction drive or direct drive can be used to retrieve hose 100 onto drum 22. A friction drive creates a tensions pull on hose 100 through the use of mechanicalized rubber or counter surfaces and a cable member. A direct drive uses a chain or other device to directly drive hose reel 20 for retrieving hose 100.

The structure of the present invention allows for shipping, deployment and retrieval all from the same prime mover (i.e. portable hose reel 20 itself). The present invention allows for the laying of a high strength three thousand (3000) psi collapsible or advanced collapsible pipeline, constructed from the continuous hose (conduit), which can be laid off of a wheel in unimproved roads and allows for lengths of pipeline exceeding forty (40) miles a day during twenty (20) hour work days.

Portable hose reel 20 can be functionally towed by any number of military or civilian vehicles. Hose reel 20 can also be deployed by helicopter over gap and river crossings. In its simplest form, a load is applied to hose reel 20 which causes hose 100 to unravel.

Prior to unraveling hose 100 to create the pipeline, a pipeline trace 150 (FIG. 11), in the form of a string of chemical lights 152, can be provided. Chemical lights 152 are preferably spaced approximately ten (10) to twelve (12) feet from each other, though such distance is not considered limiting. Chemical lights 152 automatically break out using a ratchet mechanism when pulling the string from its own storage reel or flaking box. Typically, the string of chemical lights 152 lies directly on the ground or are attached to stakes which are inserted in the ground.

In a typical scenario, a nighttime grouping of military soldiers would lay a pipeline trace 150 in conjunction with infrared lighting by laying chemical lights 152 to define the location of a pipeline 160. Using the present invention hose reel or some other device, pipeline 160 is created following the trail of pipeline trace 150 created by chemical lights 152. Other lights, other than chemical lights, such as fluorescent may be used and are also considered within the scope of the invention. Once pipeline 160 has been laid, chemical lights 152 can be removed.

The present invention is preferably dimensioned, with hose 100 wrapped around drum 22, to fit within a conventional iso container or an iso flat rack (not shown). Thus, when used with an iso container or iso flat rack, hose reel 20 can be approximately eighty one (81") inches wide by seventy four (74") inches tall. However, it should be understood that the present invention is not limited to any one set of dimensions and various sets of dimensions can be used and are all considered within the scope of the invention.

Figure 12:
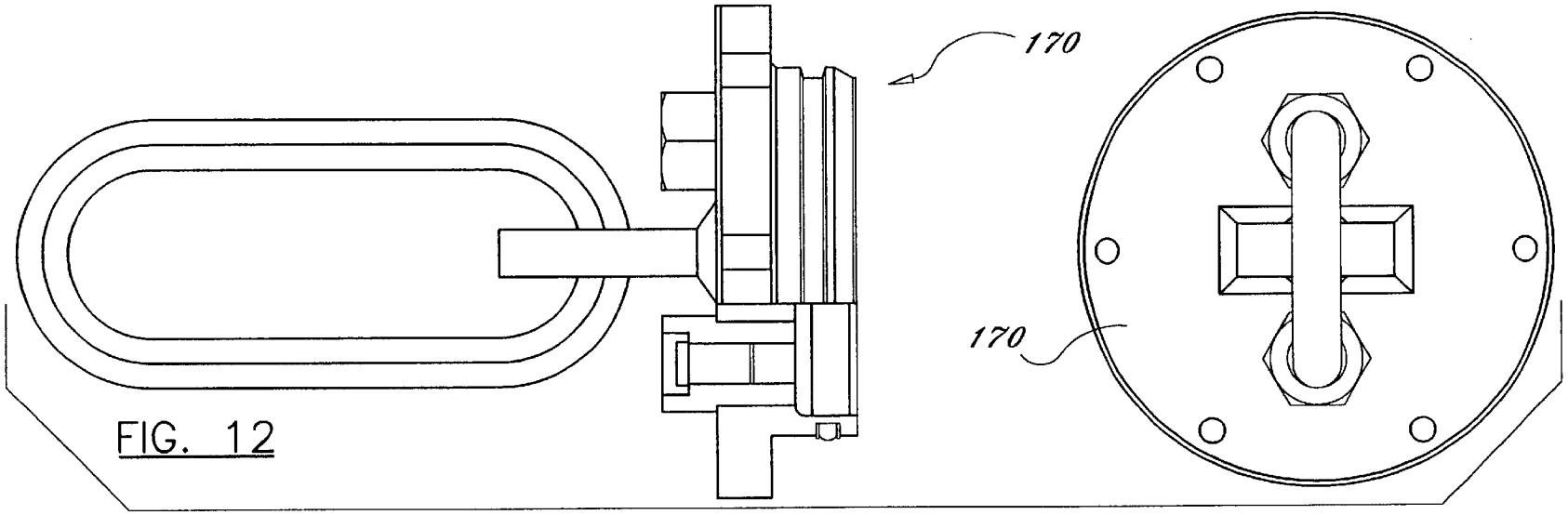
FIG. 12 illustrates a pull plug which can be use with the hose in accordance with the present invention.
Figure 13:
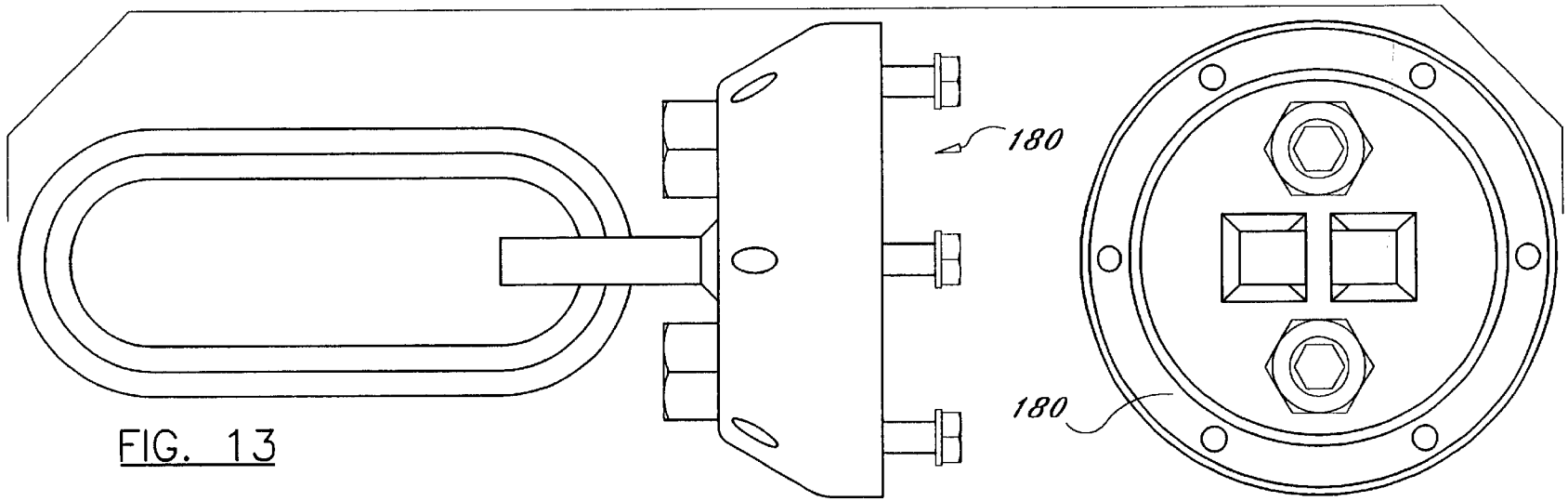
FIG. 13 illustrates a pull plug which can be use with the hose in accordance with the present invention.
Figure 17:
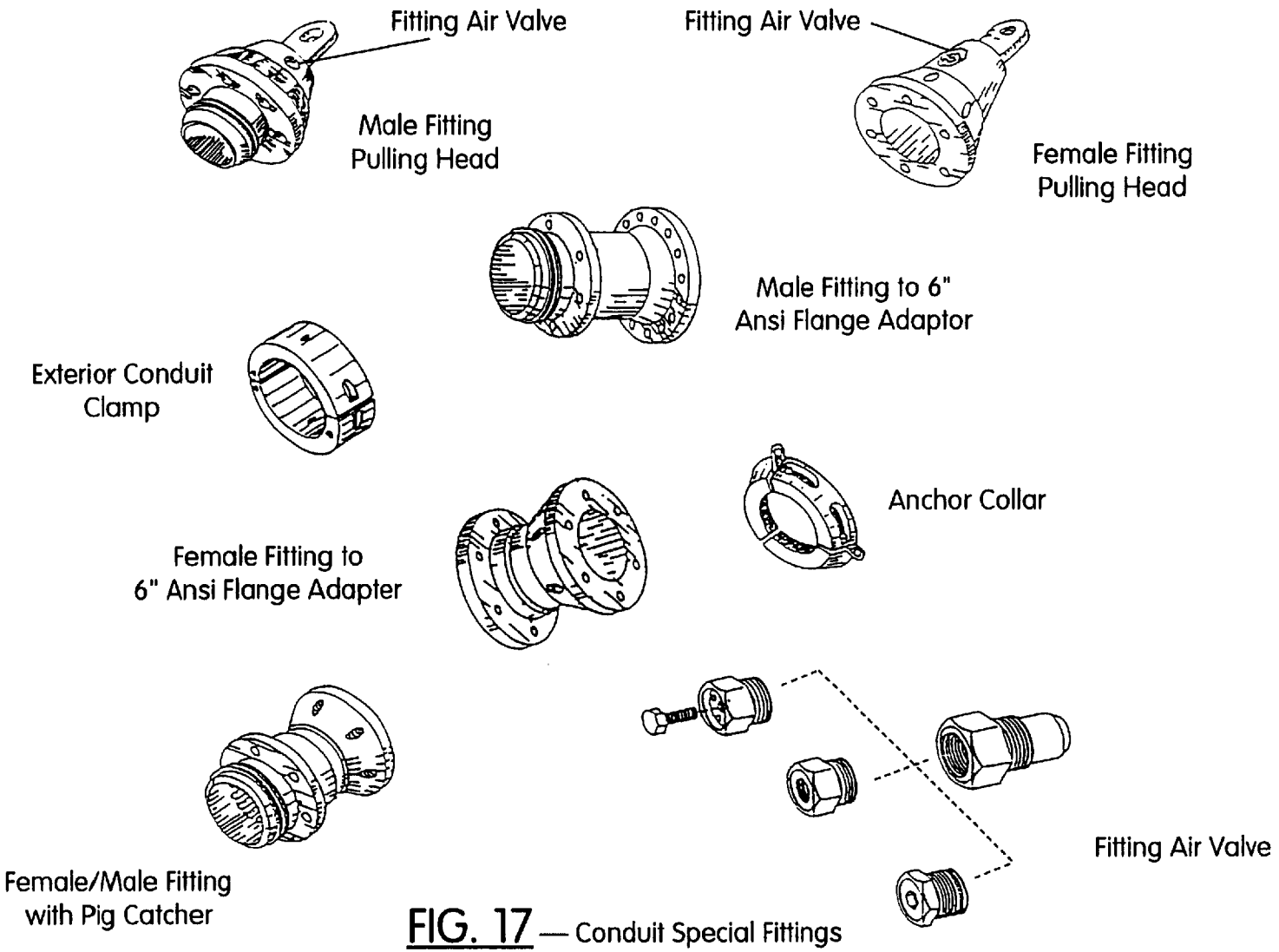
FIG. 17 illustrates a perspective view of various fittings which can be used with the hose in accordance with the present invention.
Figure 20:
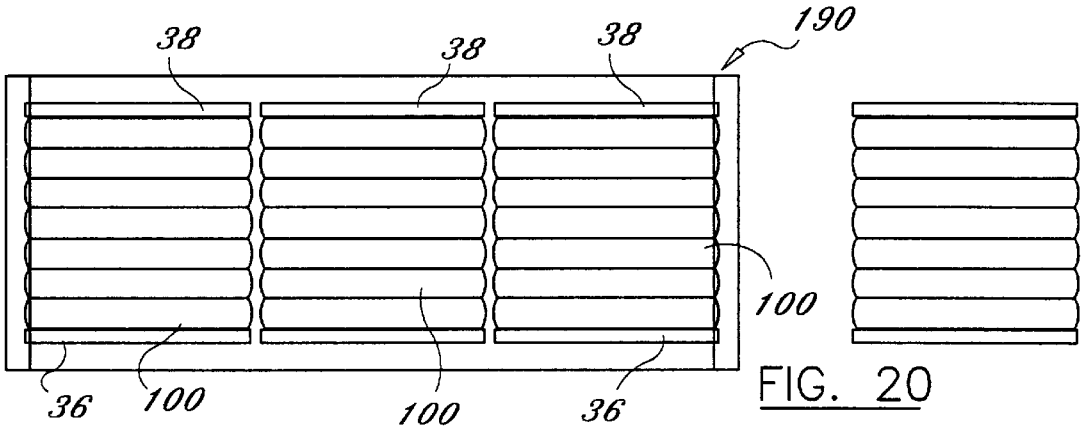
FIG. 20 illustrates a top view of the shipping rack containing one or more hose reels in accordance with the present invention.
Figure 21:
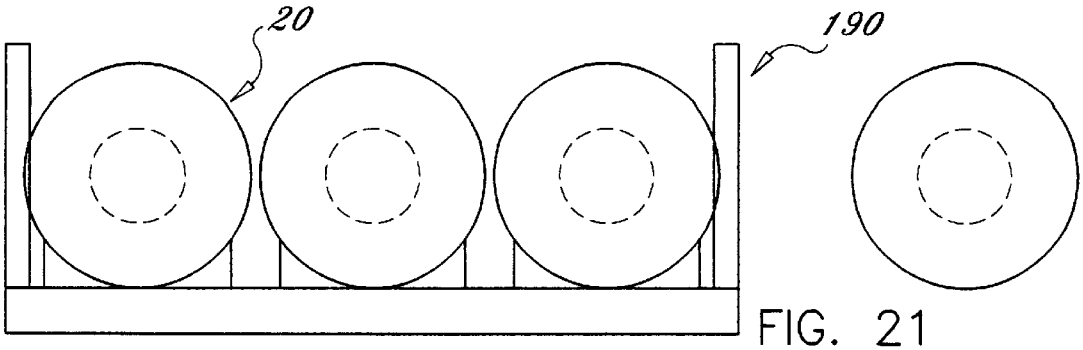
FIG. 21 illustrates a side elevational view of the shipping rack containing one or more hose reels in accordance with the present invention.

FIG. 17 illustrates various fittings which can be used with and attached to the ends of hose 100 or male or female fittings 102 and 104, respectively, as well as illustrating a male fitting 102 and a female fitting 104. FIG. 12 illustrates a pull plug 170 which can be used with hose 100. FIG. 13 illustrates a pull cap 180 which can be used with hose 100. FIGS. 20 and 21 illustrate a shipping rack 190 for hose reel 20 and a stacked hose 100. FIGS. 23 through 28 illustrate various hose connectors including elbows, "T"s, 45°s, etc. which can be used to connect hoses 100 to each other, and allows for various directions for pipeline 160.

FIGS. 29 through 33 illustrates repair fittings and procedures for use with field repair or permanent repairs to hose 100. Field repairs covers quick repair to conduit 100 in the field and preferably can be accomplished in minimal time under adverse conditions with relatively very little equipment. During an "in field" repair, A repair fitting 200, shown in FIG. 29 attached to a single groove fitting 202 (though can also be attached to low profile fitting as described above), is held in place in conduit 100 by three (3) segmented clamps which are held together by two (2) high tensile bolts each. Both the nipple and the three (3) segmented clamps are preferably deep groove seated which compresses the steel wire cord for holding power.

When applying the field repair fitting, initially the damaged area should be closely examined for exposed wire and/or loose rubber cover. The damage area of hose 100, and preferably, two to three feet of good hose, should be cutout. Conduit 100 should again be carefully inspected for looseness of the wire plies. If looseness is found, conduit 100 should be further cut under a stable area of conduit 100 is found. All cuts preferably are square, in order to allow the nipple to be correctly seated and to allow the segmented clamps to be properly seated over the shoulder of the nipple. The nipple is then inserted into conduit 100 until the stop on the nipple touches the end of conduit 100. Lubrication can be provided to assist in the insertion of the nipple. The three (3) clamps are then applied and preferably using flat washers, hex cap screws and lock nuts, the screws are gradually tightened, similar to changing a wheel on a automobile, to a torque of approximately 100 ft/lbs, which can further retightened to 100 ft/lbs, after approximately six to eight hours to compensate for any compression set of the elastomeric compounds in conduit 100.

External damage extending to the strength members or reinforcement will require reterminaton and installation of a permanent repair coupling, which can have a mechanical interference fit. Placement of the repair fitting or couplings can be achieved by using a hydraulically activated puller device (FIGS. 30 through 33). The repair coupler can be a low profile reelable fitting in either six inch or eight inch dimensions. The permanent repair fitting can be manufactured in steel with a PTF coating (teflon). Equipment which can be used to place the repair fitting include a tube skiver, cover skiver and a hand held hydraulic pump and jig.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A reel allowing for storage, transportation, deployment and retrieval of a collapsible fuel conduit, said reel comprising:

a rotatable drum member having a first end and a second end;

a first flange wheel member disposed at the first end of said drum member; and a second flange wheel member disposed at the second end of said drum member; and an axle, said axle having a first end extending outward from the first end of said rotatable drum member, said axle having a second end extending outward from the second end of said rotatable drum member, said axle first end attached to said first flange wheel member and said axle second end attached to said second flange wheel member;

wherein rotation of said drum member is independent to any movement of said first flange wheel member and said second flange wheel member.

2. The reel of claim 1 wherein said first flange wheel member is a first conestoga type wheel and said second flange wheel member is a second conestoga type wheel.

3. The reel of claim 1 further including means for transporting said drum member and said first flange wheel member and said second flange wheel member.

4. The reel of claim 2 wherein said first conestoga type wheel and said second conestoga type wheel each having a central hub, an outer rim and a plurality of spokes; wherein said plurality of spokes are attached at a first end to the central hub and at a second end to the outer rim.

5. The reel of claim 4 wherein said plurality of spokes are attached such that they are at least slightly canted outward from the hub to the outer rim.

6. The reel of claim 4 wherein said an outer surface of the outer rim is provided with an anti-abrasive material.

7. The reel of claim 3 wherein said means for transporting comprising a yoke assembly associated with said flange members.

8. The reel of claim 4 further including a yoke assembly associated with said first conestoga type wheel and said second conestoga type wheel.

9. The reel of claim 8 further including a pair of shackle plate assemblies, each of said shackle plate assemblies having a swivel plate and a bearing plate, said bearing plate attached to an outer side of the hub portion, said swivel plate snugly receiving said bearing plate and allowing said bearing plate to rotate with respect to said swivel plate.

10. The reel of claim 9 wherein said yoke assembly including a rigid portion and a chain portion.

11. The reel of claim 10 wherein said swivel plate having at least one ear member; wherein a first end of the rigid portion of said yoke assembly attached to the ear member of a first swivel plate and a second end of the rigid portion of said yoke assembly attached to the ear member of a second swivel plate.

12. The reel of claim 1 wherein said drum having a fitting cam protruding therefrom.

13. A reel allowing for storage, transportation, deployment and retrieval of a collapsible fuel conduit, said reel comprising:

a rotatable drum member having a first end and a second end;

a first conestoga type wheel disposed at the first end of said drum member, said first conestoga type wheel having a first central hub, a first outer rim and a first plurality of spokes, said first plurality of spokes attached at a first end to the first central hub and at a second end to the first outer rim, said first plurality of spokes attached such that they are at least slightly canted outward from the first hub to the first outer rim;

a second conestoga type wheel disposed at the second end of said drum member, said second conestoga type wheel having a second central hub, a second outer rim and a second plurality of spokes, said second plurality of spokes attached at a first end to the second central hub and at a second end to the second outer rim, said second plurality of spokes attached such that they are at least slightly canted outward from the second hub to the second outer rim;

an axle, said axle having a first end extending outward from the first end of said rotatable drum member, said axle having a second end extending outward from the second end of said rotatable drum member, said axle first end attached to said first central hub and said axle second end attached to said second central hub; and means for transporting said drum member and said first conestoga type wheel and said second conestoga type wheel;

wherein said drum member being rotatable independently of said first wheel and said second wheel; wherein rotation of said drum member occurs while said first wheel and said second wheel are rotating.

14. The reel of claim 13 wherein said means for transporting is a yoke assembly associated with said first Conestoga type wheel and said second conestoga type wheel.

15. The reel of claim 14 further including a pair of shackle plate assemblies, a first shackle plate assembly having a first swivel plate and a first bearing plate, said first bearing plate attached to an outer side of the first hub portion, said first swivel plate snugly receiving said first bearing plate and allowing said first bearing plate to rotate with respect to said first swivel plate; a second shackle plate assembly having a second swivel plate and a second bearing plate, said second bearing plate attached to an outer side of the second hub portion, said second swivel plate snugly receiving said second bearing plate and allowing said second bearing plate to rotate with respect to said second swivel plate.

16. The reel of claim 15 wherein said yoke assembly including a rigid portion and a chain portion.

17. The reel of claim 16 wherein said first swivel plate having a first plurality of ear members and said second swivel plate having a second plurality of ear members; wherein a first end of the rigid portion of said yoke assembly attached to a first ear member of said first swivel plate and a second end of the rigid portion of said yoke assembly attached to a first ear member of said second swivel plate.

18. A reel allowing for storage, transportation, deployment and retrieval of a collapsible fuel conduit, said reel comprising:

a rotatable drum member having a first end and a second end, said drum member having a fitting cam protruding therefrom;

a first conestoga type wheel disposed at the first end of said drum member, said first conestoga type wheel having a first central hub, a first outer rim and a first plurality of spokes, said first plurality of spokes attached at a first end to the first central hub and at a second end to the first outer rim, said first plurality of spokes attached such that they are at least slightly canted outward from the first hub to the first outer rim, said first outer rim provided with an anti-abrasive coating;

a second conestoga type wheel disposed at the second end of said drum member, said second conestoga type wheel having a second central hub, a second outer rim and a second plurality of spokes, said second plurality of spokes attached at a first end to the second central hub and at a second end to the second outer rim, said second plurality of spokes attached such that they are at least slightly canted outward from the second hub to the second outer rim, said second outer rim provided with an anti-abrasive coating;

a first shackle plate assembly having a first swivel plate and a first bearing plate, said first bearing plate attached to an outer side of the first hub portion, said first swivel plate snugly receiving said first bearing plate and allowing said first bearing plate to rotate with respect to said first swivel plate, said first swivel plate having a first plurality of ear members;

a second shackle plate assembly having a second swivel plate and a second bearing plate, said second bearing plate attached to an outer side of the second hub portion, said second swivel plate snugly receiving said second bearing plate and allowing said second bearing plate to rotate with respect to said second swivel plate, said second swivel plate having a second plurality of ear members;

an axle, said axle having a first end extending outward from the first end of said rotatable drum member, said axle having a second end extending outward from the second end of said rotatable drum member, said axle first end attached to said first central hub and said axle second end attached to said second central hub; and a substantially rigid yoke assembly, a first end of the rigid portion of said yoke assembly attached to a first ear member of said first swivel plate and a second end of the rigid portion of said yoke assembly attached to a first ear member of said second swivel plate;

wherein said drum member being rotatable independently of said first wheel and said second wheel; wherein rotation of said drum member occurs while said first wheel and said second wheel are rotating.

19. The reel of claim 18 wherein a pipeline trace is created to provide a guide for a pipeline created by using said portable conduit deployment and retrieval reel.

20. The reel of claim 1 wherein retrieval and deployment of a collapsible fuel hose associated with said drum member is accomplished while said reel is in transit.

21. The reel of claim 1 wherein said drum is a handleless rotating drum.

22. The reel of claim 20 wherein said first and second wheel members roll directly on ground and automatically unwind or retrieve a same length of the fuel conduit as the distance the reel travels during each roll to reduce or eliminate any appreciable tension build up in the fuel conduit.

23. The reel of claim 1 wherein said first wheel member, said second wheel member and said rotatable drum member defining a collapsible fuel conduit storage area.

24. The reel of claim 13 wherein said first wheel, said second wheel and said rotatable drum member defining a collapsible fuel conduit storage area.

25. The reel of claim 18 wherein said first wheel, said second wheel and said rotatable drum member defining a collapsible fuel conduit storage area.

* * * * *